US006070817A

United States Patent [19]

Yanase

[11] Patent Number: 6,070,817

[45] Date of Patent: Jun. 6, 2000

[54] PULVERIZER

[76] Inventor: Shigeo Yanase, 27-19, Gion 3-chome, Kisarazu City, Chiba, Japan

[21] Appl. No.: 09/067,227

[22] Filed: Apr. 28, 1998

[30] Foreign Application Priority Data

Feb. 12, 1988 [JP] Japan ..... 10-048904

[51] Int. Cl.[7] ..... B02C 17/00; B02C 17/20

[52] U.S. Cl. ..... 241/171; 241/176; 241/179; 241/184

[58] Field of Search ..... 241/171, 176, 241/179, 180, 184

[56] References Cited

U.S. PATENT DOCUMENTS

| | | | |
|---|---|---|---|
| 1,169,075 | 1/1916 | Gerlach | 241/184 |
| 1,215,662 | 2/1917 | Kittle | 241/184 |
| 1,388,463 | 8/1921 | Hardinge | 241/184 |
| 2,653,769 | 9/1953 | Hall | 241/137 |
| 3,254,849 | 6/1966 | Clements | 241/184 |
| 3,862,719 | 1/1975 | Muller | 241/74 |
| 5,062,601 | 11/1991 | Graf | 241/79.3 |
| 5,114,084 | 5/1992 | Yamaguchi et al. | 241/178 |
| 5,513,809 | 5/1996 | Perkel | 241/65 |
| 5,667,154 | 9/1997 | Hand | 241/184 |

*Primary Examiner*—John M. Husar
*Attorney, Agent, or Firm*—Curtis L. Harrington

[57] ABSTRACT

The present invention provides a pulverizer which can readily miniaturize a whole pulverization apparatus including the pulverizer and can be used for various purposes such as grinding aggregate or pigments, polishing decorative stones or pinballs, and mixing and stirring liquid of high density. The pulverizer is formed by a hollow rotator rotating with an article to be pulverized introduced inside and a pulverizing medium consisting of a necessary number of members, and pulverizes the article by up-and-down motions of the pulverizing medium as the hollow rotator rotates. The hollow rotator is provided with apertures formed on its outer surface at necessary portions which communicate inside to serve both as inlets and outlets for the article.

48 Claims, 11 Drawing Sheets

PRIOR ART

PULVERIZER

FIELD OF THE INVENTION

This invention relates to a pulverizer and has an object to provide a pulverizer with a high efficiency which can readily miniaturize a whole pulverization apparatus including the pulverizer and be used for various purposes such as grinding aggregate or pigments, polishing decorative stones or pinballs, and mixing and stirring liquid of high density.

PRIOR ART

Generally, tumbling mills such as rod mills and ball mills have been used so far in manufacturing industries such as a manufacture of aggregate for concrete, a manufacture of ceramics material and the like which require grinding or milling raw materials.

As typical tumbling mills used in general, an overflow type mill, an end-peripheral discharge type mill and a central-peripheral discharge type mill are shown, for example, respectively in FIGS. 22, 23 and 24.

In the shown mills, a grinding medium consisting of a tot of members (rods or balls) is arranged inside each cylinder of the mills. A raw material (an article to be grinded) is thrown into each of the cylinder as shown by an arrow in the drawings to be grinded by impact and friction resulted from up-and-down motions of the grinding medium as the cylinder rotates and then discharged.

PROBLEMS TO BE SOLVED BY THE INVENTION

The above mentioned conventional mills have problems as follows.

The thrown raw material flows in parallel with a rotation axis of the cylinder so that, especially when the grinding medium consists of rods, the raw material is prone to be discharged without hitting against the rods. Grinding the raw material for a long time to prevent it from being discharged without hitting against the rods causes an overgrinding resulting in a problem of a low yield.

Since a contacting area of the grinding medium and the raw material depends only on a surface area of the grinding medium, a whole milling apparatus including each of the mills should be increased in size to improve the grind efficiency so that a large space is required to install the apparatus.

Furthermore, in batch processing, the milling apparatus should be stopped to sample the thrown raw material so that a sampling lowers the grind efficiency.

SUMMARY OF THE INVENTION

To solve the above mentioned problems, the present invention provide a pulverizer comprising a hollow rotator rotating with an article to be pulverized introduced inside and a pulverizing medium consisting of a necessary number of members which pulverizes the article by up-and-down motions of the pulverizing medium as the hollow rotator rotates. The hollow rotator is provided with apertures which are formed on its outer surface at necessary portions and communicate inside to serve both as inlets and outlets for the article. The pulverizer has effects described hereinafter.

The article to be pulverized is introduced through the apertures of the hollow rotator to hit perpendicularly against the pulverizing medium and is never discharged without hitting the pulverizing medium like in prior tumbling mills so that the pulverizer has a superior pulverization efficiency, and can minimize a whole pulverization apparatus including the pulverizer and prevent an overgrinding by operating the apparatus for a long time.

By tapering each of the apertures with its cross dimension increased outwardly and/or by tilting each of the apertures to a direction of rotation of the hollow rotator, the article can be readily introduced into the hollow rotator to improve the pulverization efficiency.

By arranging the hollow rotator in a pulverization tank into which the article is thrown, the article can be pulverized by consecutive processing or by batch processing. Moreover, it is possible to sample the article without stopping the apparatus.

By arranging a necessary number of core bars or core balls inside each of the members forming the pulverizing medium which is a hollow body provided with through holes on its outer surface at necessary portions communicating inside, a contacting area of the article and the pulverizing medium can be greatly increased to miniaturize the whole pulverizing apparatus without lowering the pulverization efficiency.

DETAILED DESCRIPTION OF THE INVENTION

Figure 1:
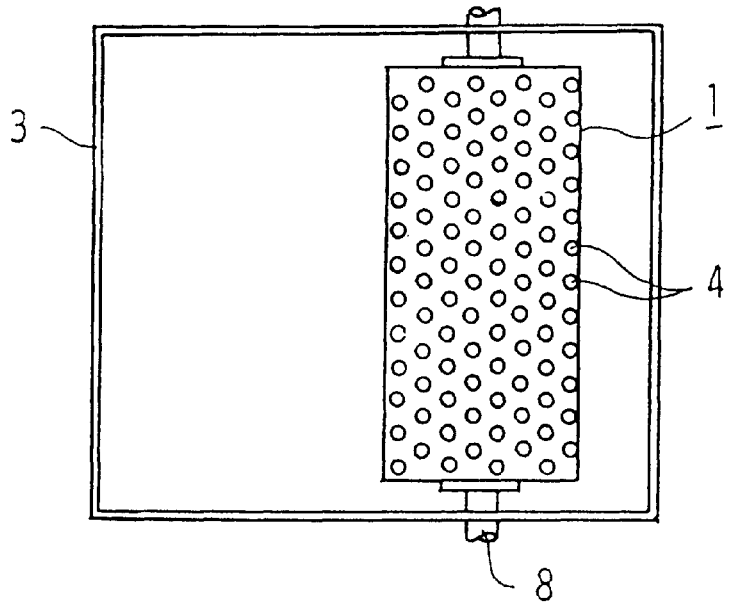
FIG. 1 is a plan view showing a preferred embodiment of a pulverizer relating to the present invention.

Embodiments of a pulverizer relating to the present invention will be described hereinafter referring to the drawings.

Figure 2:
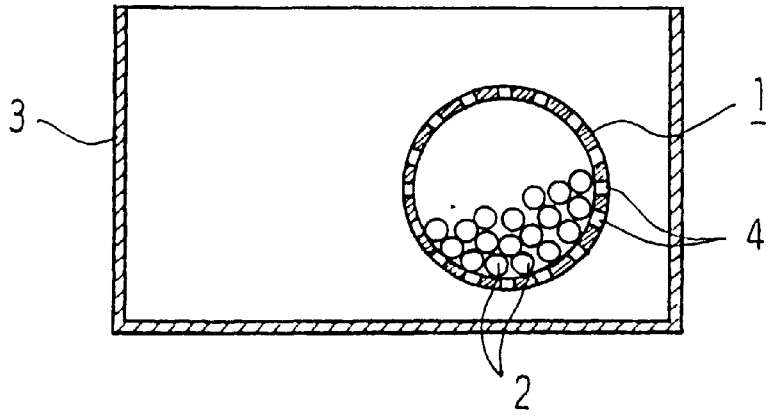
FIG. 2 is a cross sectional view of a preferred embodiment of a pulverizer relating to the present invention.

FIG. 1 is a plan view showing a preferred embodiment of the present pulverizer, and FIG. 2 is a schematic cross sectional view of the preferred embodiment of the pulverizer.

The shown pulverizer comprises a hollow rotator (1) which rotates with an article to be pulverized introduced inside, a pulverizing medium of a necessary number of members (2) arranged inside the hollow rotator (1), and a pulverization tank (3) into which the article to be pulverized are thrown. In the pulverizer, the article to be pulverized is thrown into the pulverization tank (3) to be introduced into the hollow rotator (1) and pulverized by up-and-down motions of the members (2) forming the pulverizing medium as the hollow rotator (1) rotates.

The rotator (1) is driven to rotate by connecting its central axis (8) supported rotatably by a bearing means (not shown) with a driving motor axis (not shown) through a pulley or a belt.

In the present pulverizer, a driving mechanism to rotate the rotator (1) is not restricted, and any driving mechanisms used for known rod mills or ball mills can be favorably used.

Figure 3:
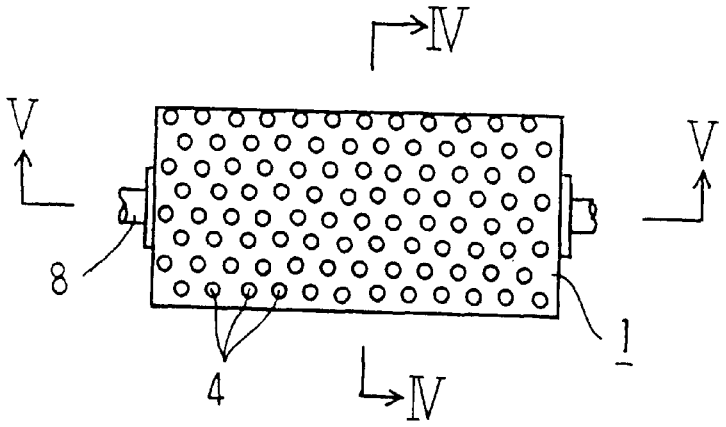
FIG. 3 is a front view showing a hollow rotator with a pulverizing medium of plural members arranged inside.
Figure 4:
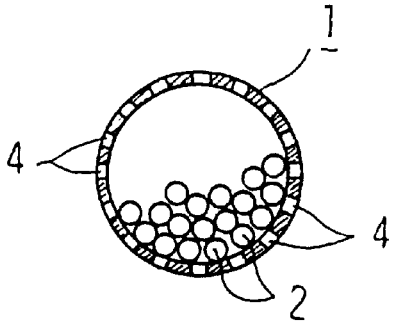
FIG. 4 is a cross sectional view taken along the line IV—IV of FIG. 3.
Figure 5:
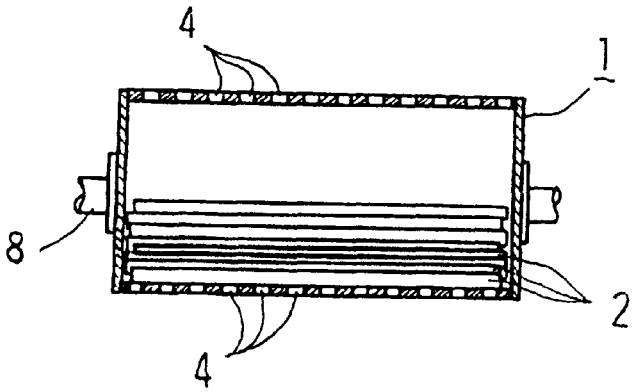
FIG. 5 is a cross sectional view taken along the line V—V of FIG. 3.

FIG. 3 is a front view showing the hollow rotator (1) with the members (2) forming pulverizing medium arranged inside, FIG. 4 is a cross sectional view taken along the line IV—IV of FIG. 3, and FIG. 5 is a cross sectional view taken along the line V—V of FIG. 3.

It is the most essential feature of the present pulverizer that, as shown in FIGS. 4 and 5, plural apertures (4) are provided on an outer surface of the hollow rotator (1) communicating inside the hollow rotator (1).

The article to be pulverized is introduced into the hollow rotator (1) through the apertures (4), pulverized by up-and-down motions of the members (2) forming the pulverizing medium inside the hollow rotator (1), and then discharged from the apertures (4).

In the present pulverizer, although it is most favorable to provide the apertures (4) throughout the outer surface of the hollow rotator (1) since the apertures (4) act as passages for the article as described above, the apertures (4) may be provided at a part of the outer surface of the hollow rotator (1) according to circumstances.

There is no restriction about the size and the number of the apertures (4). The apertures (4) can be suitably formed according to the size of the hollow rotator (1), the kind of the article to be pulverized, and a necessary size of the article after a pulverization.

Figure 6:
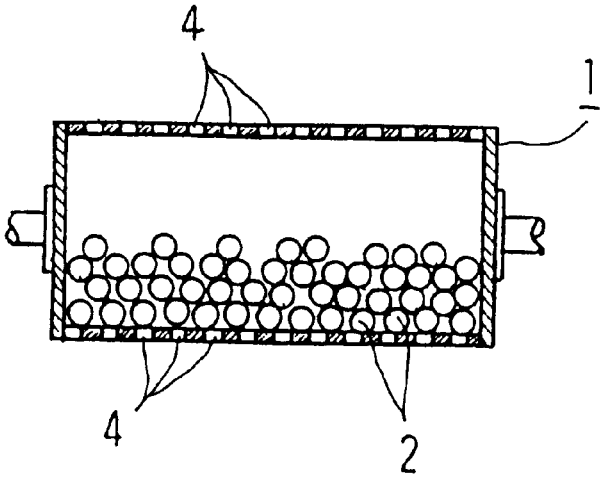
FIG. 6 is a cross sectional view when the members forming the pulverizing medium of a pulverizer relating to the present invention are balls.

The present invention does not restrict the kind (the shape) of the members (2) forming the pulverizing medium, and may adopt rods as shown in FIG. 5, or balls as shown in FIG. 6.

In view of the pulverization efficiency, although it is favorable to adjust the size and the number of the members (2) forming the pulverizing medium so that the members (2) forming the pulverizing medium can account for about 40% by volume of the hollow rotator (1), the size and the number are not especially restricted. The size of the members (2) forming pulverizing medium, however, must be bigger than that of the apertures (4) not to project from the apertures (4).

Figure 7:
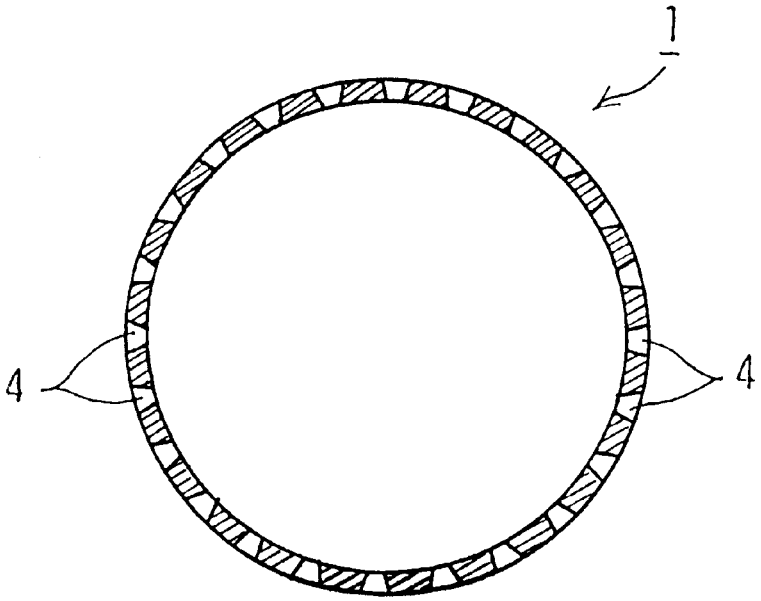
FIG. 7 is a cross sectional view showing an embodiment of apertures of the hollow rotator.

The apertures (4) are favorably tapered outwardly as shown in FIG. 7. Since the article to be pulverized can be readily introduced into the hollow rotator (1) to improve the pulverization efficiency by tapering each of the apertures (4) with its cross dimension increased outwardly.

Figure 8:
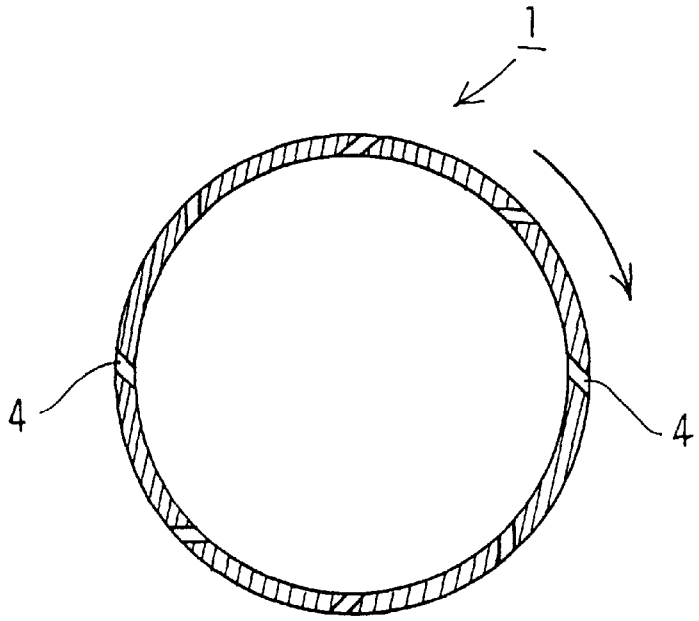
FIG. 8 is a cross sectional view showing another embodiment of the apertures of the hollow rotator.

The pulverization efficiency can be improved also by forming the apertures (4) tilted to a direction (indicated by an arrow in FIG. 8) of rotation of the hollow rotator (1) as shown in FIG. 8 to introduce the article to be pulverized readily into the hollow rotator (1).

Figure 9:
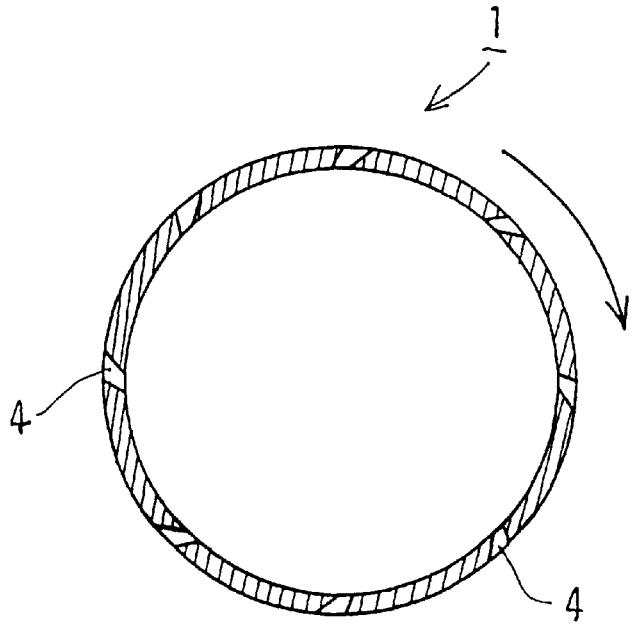
FIG. 9 is a cross sectional view showing still another embodiment of the apertures of the hollow rotator.

As shown in FIG. 9, it is more favorable to combine the above mentioned forming methods of the apertures (4), i.e., to form each of the apertures (4) tapered with its cross dimension increased outwardly and tilted to a direction (indicated by an arrow in FIG. 9) of rotation of the hollow rotator (1) so that the pulverization efficiency can be further improved.

Figure 10:
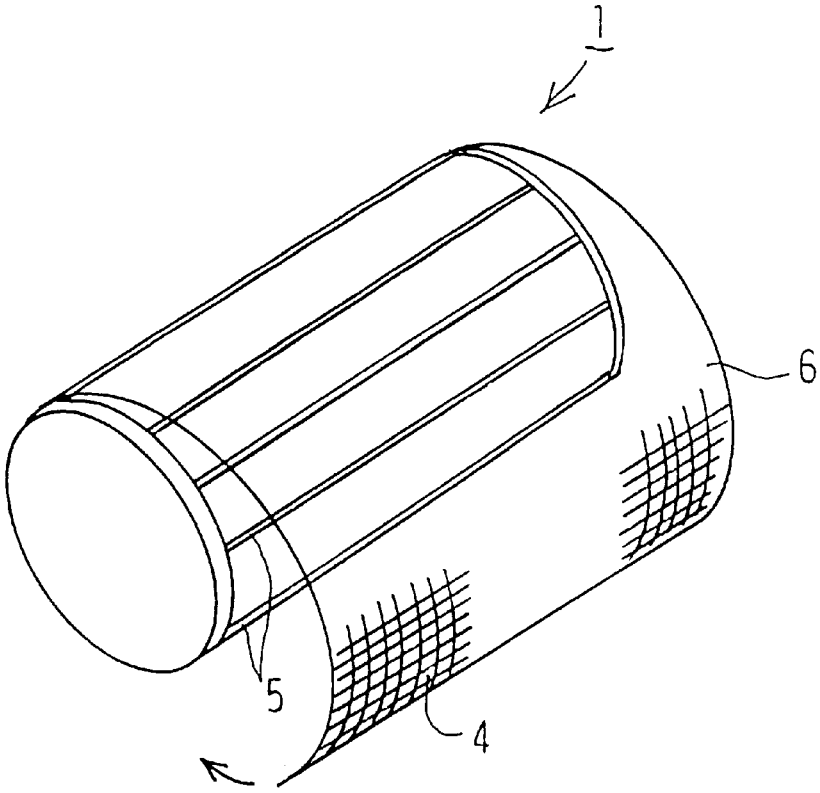
FIG. 10 shows an embodiment of a method to form the apertures of the hollow rotator.
Figure 11:
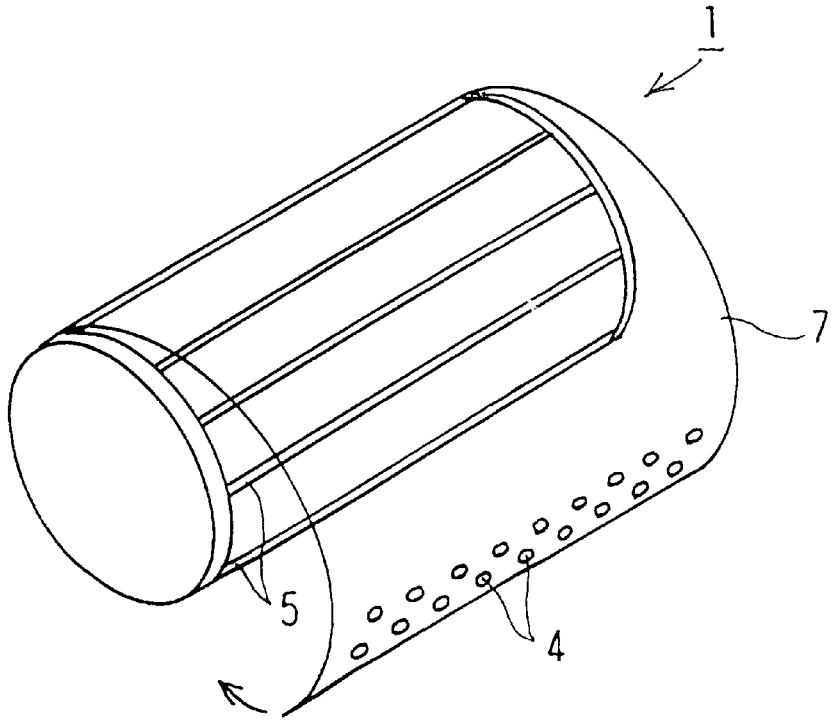
FIG. 11 shows another embodiment of the method to form the apertures of the hollow rotator.

In the present invention, although the apertures (4) may be formed by providing a cylinder body with through holes as described above, it is also possible to form the apertures by putting a wire gauze sheet (6) round a frame of reinforcing steel and the like to utilize meshes of the wire gauze sheet (6) as the apertures (4) as shown FIG. 10, or to putting a punching metal sheet (7) round the frame to utilize punching holes of the punching metal sheet (7) as the apertures (4) as shown in FIG. 11.

The present invention only requires forming the apertures (4) on the outer surface of the hollow rotator (1) communicating inside the hollow rotator (1) and never restricts the sizes and the forming methods of the hollow rotator (1) and the apertures (4) so that various embodiments can be adopted unless they deteriorate the effects of the present invention.

Each of the members (2) forming the pulverizing medium can be a hollow body with through holes similar to the hollow rotator (1).

Figure 12:
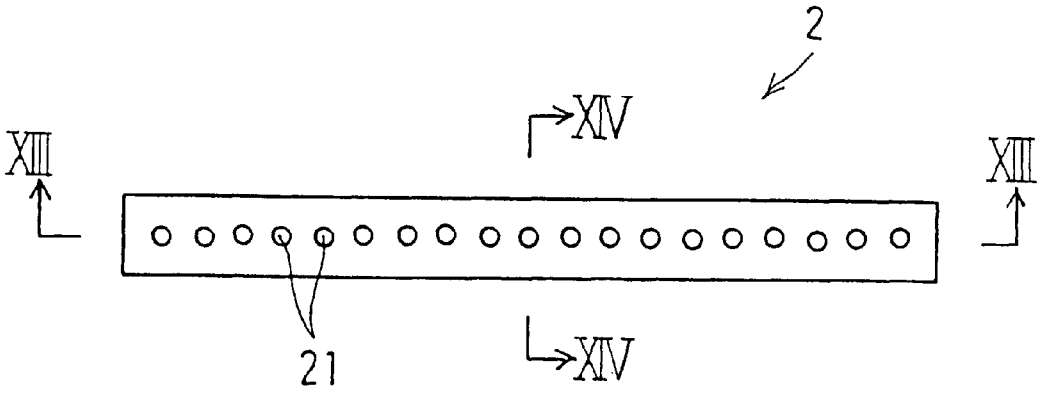
FIG. 12 is a front view showing an embodiment of the pulverizing medium.
Figure 13:
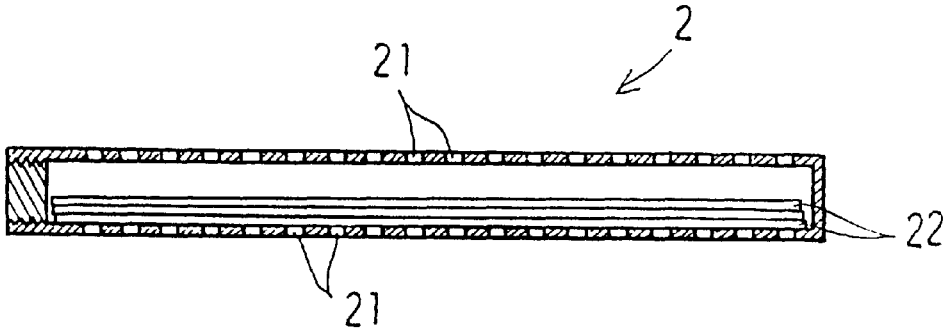
FIG. 13 is a cross sectional view taken along the line XIII—XIII of FIG. 12.
Figure 14:
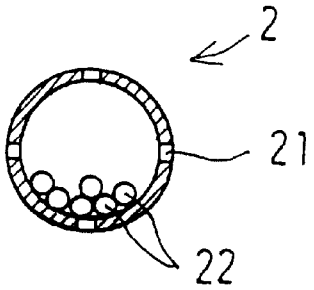
FIG. 14 is a cross sectional view taken along the line XIV—XIV of FIG. 12.

FIG. 12 is a front view showing an embodiment of the members (2) forming the pulverizing medium, FIG. 13 is a cross sectional view taken along the line XIII —XIII, and FIG. 14 is an enlarged cross sectional view taken along the line XIV —XIV.

The shown member (2) is a hollow body provided with through holes (21) on its outer surface communicating inside and core bars (22) arranged inside.

Figure 15:
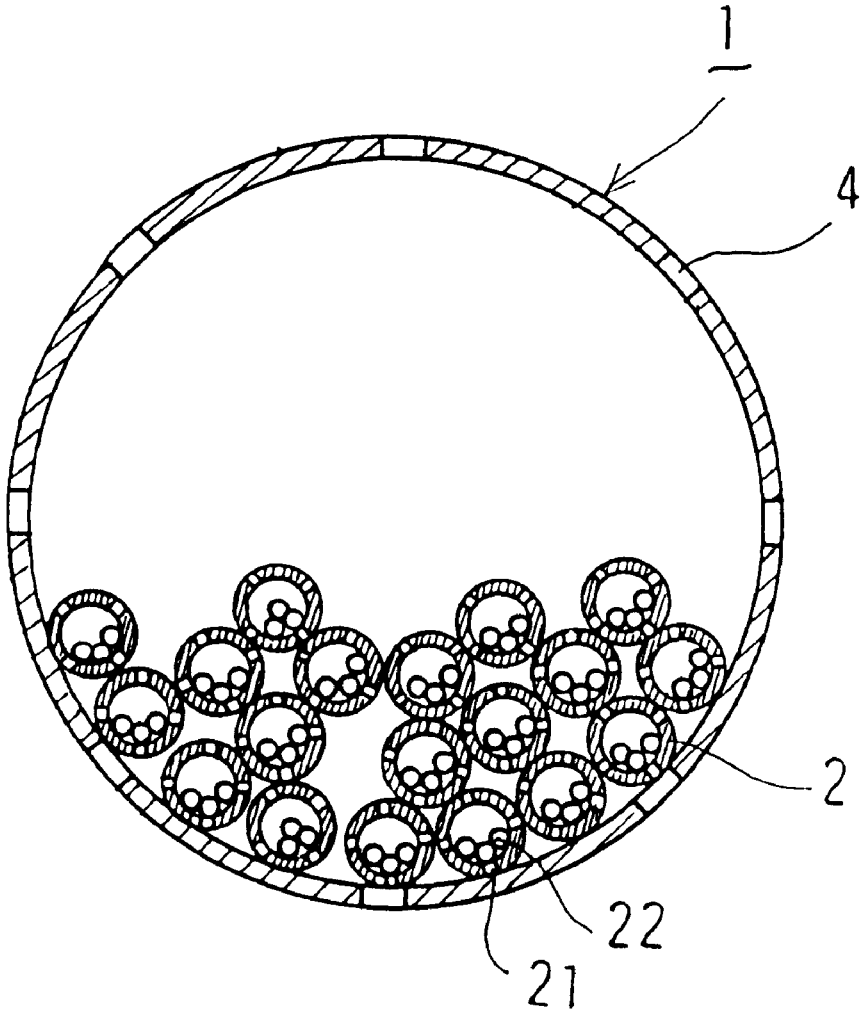
FIG. 15 is a cross sectional view showing the hollow rotator with the pulverizing medium arranged inside.

As shown in FIG. 15, the members (2) each formed as shown in FIGS. 12 through 14 are arranged inside the hollow rotator (1), which is driven to rotate. The article to be pulverized introduced into the hollow rotator (1) is pulverized by contacting with outer surfaces of the members (2) while the article is introduced into the members (2) via thorough holes (21) and pulverized by contacting with the core bars (22) so that the article can be extremely efficiently pulverized.

Figure 16:
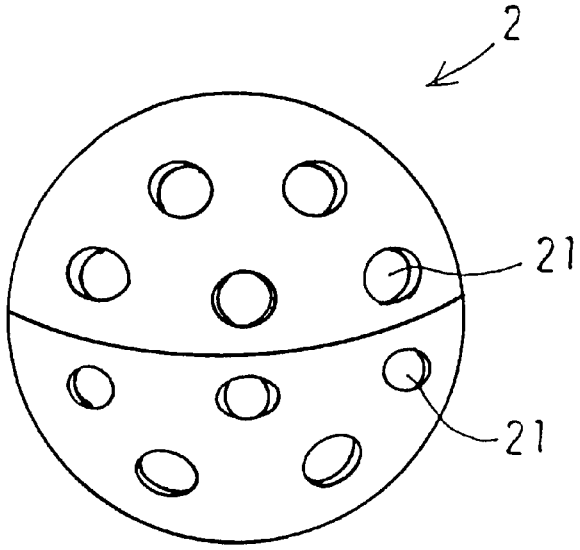
FIG. 16 is an outer view showing another embodiment of the pulverizing medium.
Figure 17:
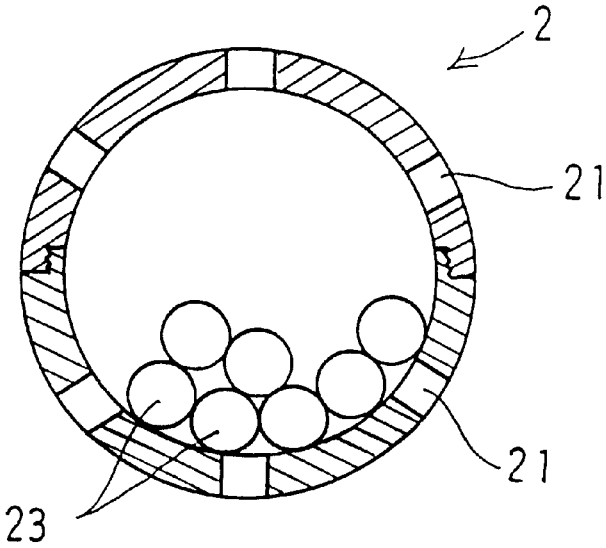
FIG. 17 is a cross sectional view of FIG. 16.

FIGS. 16 and 17 are respectively an outer view and a cross sectional view showing one of the members (2) forming the pulverizing medium each formed as a ball.

The shown member (2) is a hollow sphere of two jointed hemispheres with through holes (21) on its outer surface communicating inside and core balls (23) arranged inside.

As shown in FIG. 15, the members (2) each formed as shown in FIGS. 16 and 17 are arranged inside the hollow rotator (15), which is driven to rotate. The article to be pulverized introduced into the hollow rotator (1) is pulverized by contacting with outer surfaces of the members (2) while the article is introduced into the members (2) via thorough holes (21) and pulverized by contacting with the core balls (23) so that the article can be extremely efficiently pulverized.

Each of the members (2) forming the pulverizing medium may be formed as a hollow prism.

Figure 18:
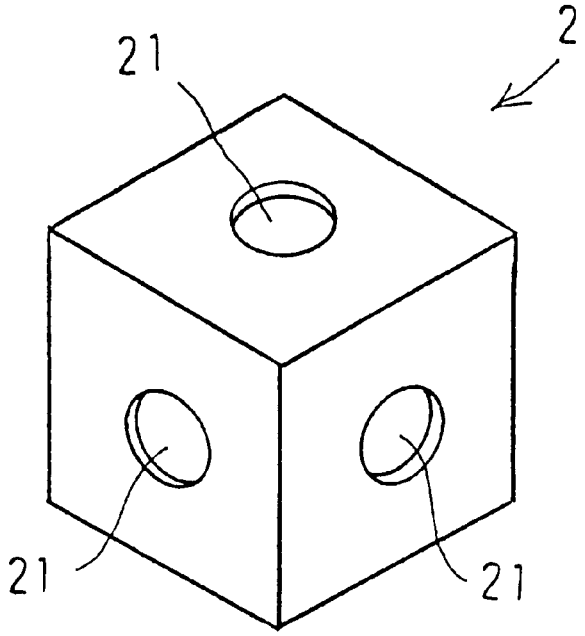
FIG. 18 is an outer view showing still another embodiment of the pulverizing medium.
Figure 19:
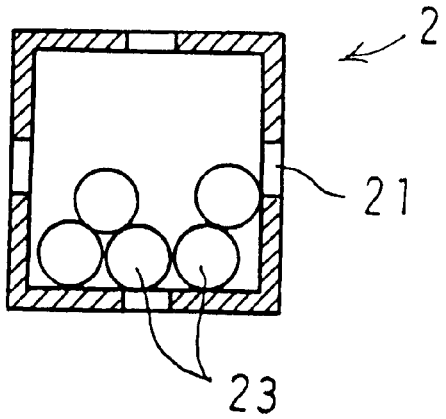
FIG. 19 is a cross sectional view of FIG. 18.

FIGS. 18 and 19 are respectively an outer view and a cross sectional view showing one of the members (2) forming the pulverizing medium each formed as a hollow cube.

The shown member (2) is a hollow cube with through holes (21) on its outer surface communicating inside and core balls (23) arranged inside.

The members (2) each formed as shown in FIGS. 18 and 19 are also arranged inside the hollow rotator (1), which is driven to rotate. The article to be pulverized is pulverized by contacting with outer surfaces of the members (2) and with the core balls (23) inside the members (2) so that the article can be extremely efficiently pulverized.

When each of the members (2) forming the pulverizing medium is formed as a hollow body with through holes, the shapes and the combination of the members (2) and cores arranged inside the members are never restricted to the shown embodiments. For example, it is also favorable to arrange core bars inside the members (2) each formed as a hollow rectangular parallelepiped or to arrange core cubes inside the members (2) each formed as a hollow sphere.

The present invention never restricts the shape of the hollow rotator (1) and can adopt various embodiments of the hollow rotator (1) such as a sphere, an elliptic cylinder, a hexagonal prism, a rectangular prism and so on, as long as the hollow rotator has an inside space to accept the pulverizing medium and the article to be pulverized, and apertures (4) to introduce the article.

Figure 20:
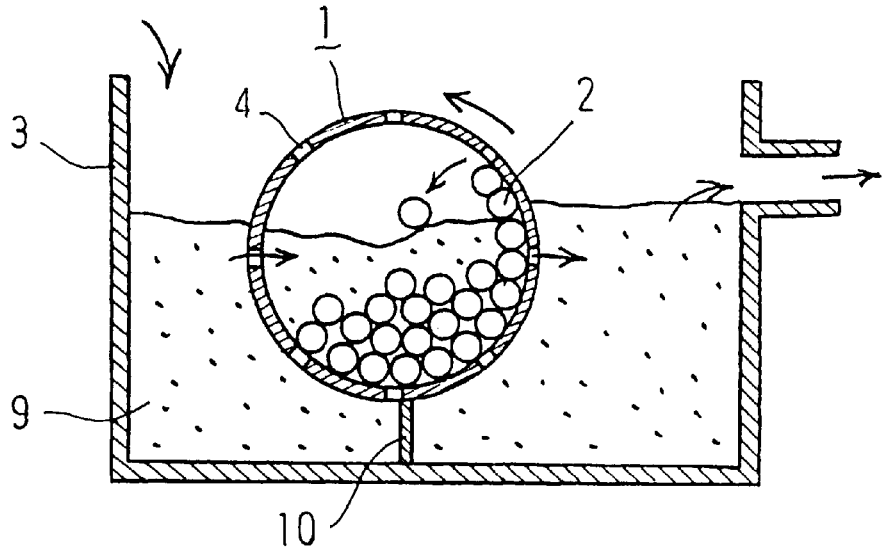
FIG. 20 is a view to explain how a pulverizer relating to the present invention works.

How the present pulverizer comprised as described above works will be explained hereinafter based on FIG. 20.

The article (9) to be pulverized is thrown into the pulverization tank (3). The thrown article (9) is introduced into the hollow rotator (1) through apertures (4) as the hollow rotator (1) rotates.

By providing a partition plate (10) between an upper surface of a bottom portion of the pulverization tank (3) and a bottom end portion of the hollow rotator (1), the whole of the thrown article (9) can be introduced into the hollow rotator (1) and prevented from being discharged without passing through the hollow rotator (1).

The pulverizing medium repeats up-and-down motions inside the hollow rotator (1) by rising along an inner surface of the hollow rotator (1) by centrifugal force and falling down when the centrifugal force balances with gravity. The article introduced into the hollow rotator (1) is pulverized by impact and friction of the up-and-down motions of the pulverizing medium.

Thus pulverized article is transmitted outside the hollow rotator (1) and then discharged outside the pulverization tank (3).

The inside of the pulverization tank (3) is maintained under negative pressure at a rotation start side of the hollow rotator (1) (at a side into which the article (9) is thrown) and under positive pressure at a rotation finish end of the hollow rotator (1) (at a side from which the article (9) is discharged) by a pumping action of rotations of the hollow rotator so that the article (9) successively thrown into the pulverization tank (3) can be automatically introduced into the hollow rotator (1) and then discharged without any additional supply mechanism such as a pump.

The present pulverizer can perform both of a wet pulverization by throwing the article to be pulverized with water and a dry pulverization with no use of water.

The present pulverizer may pulverize the article to be pulverized successively as mentioned above and can pulverize the article also by batch processing. For the batch processing of the article to be pulverized, the hollow rotator (1) is kept being driven to rotate for a necessary time after throwing the article into the pulverization tank (3) and then the pulverized article of a necessary particle size can be taken out. Thus the article can be taken out from the pulverization tank (3) for sampling during the batch processing without stopping the pulverizer.

Figure 21:
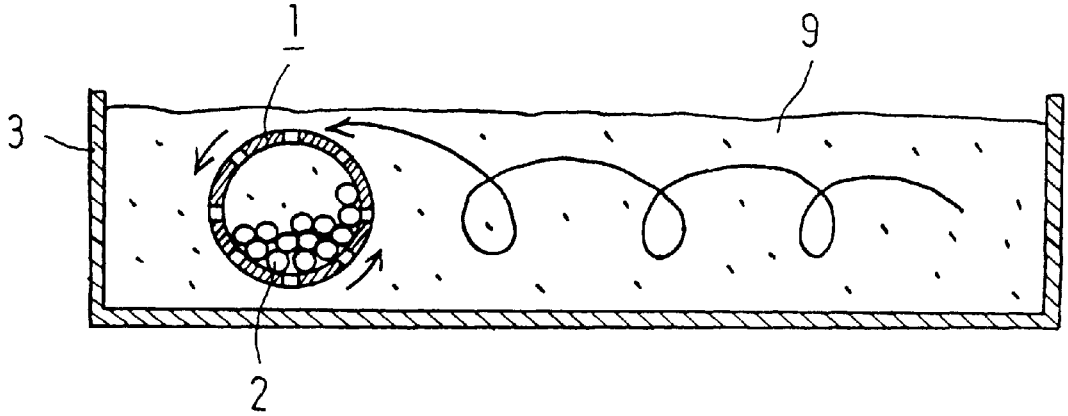
FIG. 21 is a view to explain how a pulverizer relating to the present invention works.
Figure 22:
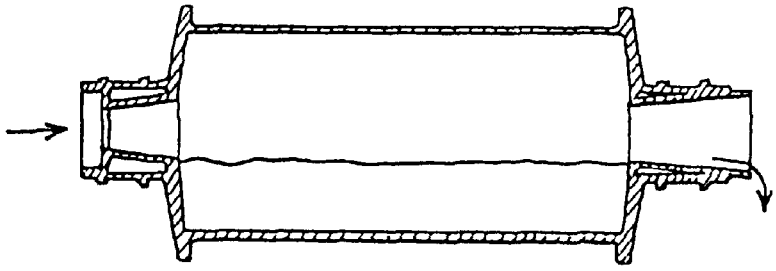
FIG. 22 is a cross sectional view showing an example of prior grinders.
Figure 23:
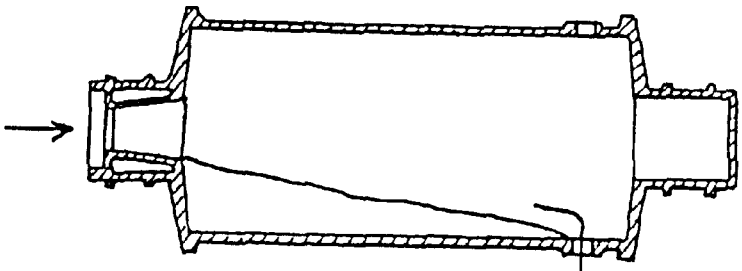
PRIOR ART FIG. 23
FIG. 23 is a cross sectional view showing another example of prior grinders.
Figure 24:
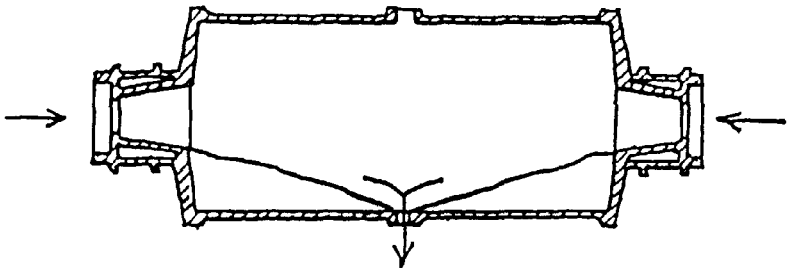
PRIOR ART FIG. 24
FIG. 24 is a cross sectional view showing still another example of prior grinders.

The present pulverizer can pulverize the article to be pulverized stored in a big tank (e.g. a liquid fertilizer tank) by arranging the hollow rotator (1) inside the tank and driving the hollow rotator (1) to rotate. When the tank is big and the article to be pulverized has a high viscosity, the hollow rotator (1) is self-propelled and rotates in the tank (3) as shown in FIG. 21 to pulverize the article evenly. The article to be pulverized in the tank having a low viscosity can be evenly pulverized by the aforesaid pumping action without self-propelling the hollow rotator (1).

EMBODIMENT

The effects of the pulverizer relating to the present invention will be described more clearly in the following embodiments. Note that the present invention is not restricted to the following embodiments.

[EMBODIMENTS AND COMPARATIVE TESTS]

1) Grinding

Sand having a particle size from 1mm to 5 mm, a true specific gravity of 2.65 (an apparent specific gravity of 1.6), a soft-particles contaminating ratio of 7% (soft particles: clay lumps and soft stones) produced in Kisarazu City, Chiba, JAPAN, as a raw material was grinded respectively by a prior rod mill (produced by Kawasaki Heavy Industrial Ltd.) and the present pulverizer (as shown in FIGS. 1 through 4). Results are shown in Table 1.

TABLE 1

| | | PRESENT PULVERIZER | PRIOR ROD MILL |
|---|---|---|---|
| DIAMETER × LENGTH (mm) | | 600 × 1200 | 2100 × 4500 |
| POWER (kW) | | 33 | 110 |
| AMOUNT OF THROWN ARTICLE (t/h) | | 150 | 40 |
| SOFT-PARTICLES REMOVAL RATIO (%) | | 90 | 40 |
| WATER ABSORPTION RATIO (%) | BEFORE GRINDING | 4.5 | 4.5 |
| | AFTER GRINDING | 1.8 | 3.8 |

As obviously shown in Table 1, although the present pulverizer was smaller than the prior rod mill and consumed power only about one third as much as the prior rod mill consumed, the present pulverizer grinded the sand three times or more as much as the prior rod mill grinded with respect to time to produce a large quantity of aggregate for concrete of high quality with an extremely high soft-particles removal ratio of 90% and a greatly low water absorption ratio of 1.8% after grinding for a short time.

2) Milling

Waste concrete having a particle size from 1mm to 5mm and a true specific gravity of 2.65 (an apparent specific gravity of 1.4) as a raw material was milled respectively by a prior rod mill (produced by Kawasaki Heavy Industrial Ltd.) and the present pulverizer (as shown in FIGS. 1 through 4). Results are shown in Table 2.

TABLE 2

| | | PRESENT PULVERIZER | PRIOR ROD MILL |
|---|---|---|---|
| DIAMETER × LENGTH (mm) | | 600 × 1200 | 2100 × 4500 |
| POWER (kW) | | 33 | 60 |
| AMOUNT OF THROWN ARTICLE (t/h) | | 100 | 30 |
| APPARENT SPECIFIC GRAVITY | BEFORE MILLING | 1.4 | 1.4 |
| | AFTER MILLING | 1.6 | 1.45 |
| WATER ABSORPTION RATIO (%) | BEFORE MILLING | 10 | 10 |
| | AFTER MILLING | 2.0 | 7 |

As obviously shown in Table 2, although the present pulverizer was smaller than the prior rod mill and consumed power only about half as much as the prior rod mill consumed, the present pulverizer milled the waste concrete three times or more as much as the prior rod mill milled with respect to time to produce a large quantity of reclaimed sand of high quality with a large apparent specific gravity of 1.6 and a low water absorption ratio of 2.0% after milling for a short time.

The pulverizer relating to the present invention can be used for various purposes such as grinding pigments or ceramics materials, polishing decorative stones or pinballs, and mixing and stirring liquid of high density in addition to the above mentioned grinding and milling, and there is no restriction for uses of the pulverizer.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

I claim:

1. A pulverizer comprising:

a cylindrically shaped hollow rotator having an inside portion for rotating with an article to be pulverized introduced inside;

a pulverizing medium consisting of a plurality of members for pulverizing said article by up-and-down motions of the pulverizing medium as the cylindrically shaped hollow rotator rotates said hollow rotator having a plurality of apertures which are formed on a surrounding wall of said cylindrically shaped hollow rotator and which are in communication with said inside portion to serve both as inlets into and outlets of the hollow rotator for the article; and a pulverization tank for accepting said article to be pulverized and said pulverizing medium, said cylindrically shaped hollow rotator rotationally mounted within said pulverization tank.

2. The pulverizer as set forth in claim 1, wherein said apertures are tapered with a cross dimension increased outwardly.

3. A pulverizer as set forth in claim 2, wherein said hollow rotator is formed as one of a circular cylinder, an elliptic cylinder, a sphere and a prism.

4. A pulverizer as set forth in claim 3, wherein each of said members forming the pulverizing medium is formed as one of a rod, a ball and a rectangular parallelepiped.

5. A pulverizer as set forth in claim 4, wherein each of said members forming the pulverizing medium is a hollow body and has through holes which are formed on its outer surface at necessary portions and communicate inside.

6. A pulverizer as set forth in claim 5, wherein each of said members forming the pulverizing medium is formed as a rod and has a necessary number of core bars arranged inside.

7. A pulverizer as set forth in claim 5, wherein each of said members forming the pulverizing medium is formed as one of a ball and a rectangular parallelepiped and has a necessary number of core balls arranged inside.

8. A pulverizer as set forth in claim 3, wherein each of said members forming the pulverizing medium is a hollow body and has through holes which are formed on its outer surface at necessary portions and communicate inside.

9. A pulverizer as set forth in claim 8, wherein each of said members forming the pulverizing medium is formed as a rod and has a necessary number of core bars arranged inside.

10. A pulverizer as set forth in claim 8, wherein each of said members forming the pulverizing medium is formed as one of a ball and a rectangular parallelepiped and has a necessary number of core balls arranged inside.

11. A pulverizer as set forth in claim 2, wherein each of said members forming the pulverizing medium is formed as one of a rod, a ball and a rectangular parallelepiped.

12. A pulverizer as set forth in claim 11, wherein each of said members forming the pulverizing medium is a hollow body and has through holes which are formed on its outer surface at necessary portions and communicate inside.

13. A pulverizer as set forth in claim 12, wherein each of said members forming the pulverizing medium is formed as a rod and has a necessary number of core bars arranged inside.

14. A pulverizer as set forth in claim 12, wherein each of said members forming the pulverizing medium is formed as one of a ball and a rectangular parallelepiped and has a necessary number of core balls arranged inside.

15. A pulverizer as set forth in claim 2, wherein each of said members forming the pulverizing medium is a hollow body and has through holes which are formed on its outer surface at necessary portions and communicate inside.

16. A pulverizer as set forth in claim 15, wherein each of said members forming the pulverizing medium is formed as a rod and has a necessary number of core bars arranged inside.

17. A pulverizer as set forth in claim 15, wherein each of said members forming the pulverizing medium is formed as one of a ball and a rectangular parallelepiped and has a necessary number of core balls arranged inside.

18. The pulverizer pulverizer as set forth in claim 1, wherein said apertures being tilted in a direction of rotation of the hollow rotator.

19. A pulverizer as set forth in claim 18, wherein said hollow rotator is formed as one of a circular cylinder, an elliptic cylinder, a sphere and a prism.

20. A pulverizer as set forth in claim 19, wherein each of said members forming the pulverizing medium is formed as one of a rod, a ball and a rectangular parallelepiped.

21. A pulverizer as set forth in claim 20, wherein each of said members forming the pulverizing medium is a hollow body and has through holes which are formed on its outer surface at necessary portions and communicate inside.

22. A pulverizer as set forth in claim 21, wherein each of said members forming the pulverizing medium is formed as a rod and has a necessary number of core bars arranged inside.

23. A pulverizer as set forth in claim 21, wherein each of said members forming the pulverizing medium is formed as one of a ball and a rectangular parallelepiped and has a necessary number of core balls arranged inside.

24. A pulverizer as set forth in claim 19, wherein each of said members forming the pulverizing medium is a hollow body and has through holes which are formed on its outer surface at necessary portions and communicate inside.

25. A pulverizer as set forth in claim 24, wherein each of said members forming the pulverizing medium is formed as a rod and has a necessary number of core bars arranged inside.

26. A pulverizer as set forth in claim 24, wherein each of said members forming the pulverizing medium is formed as one of a ball and a rectangular parallelepiped and has a necessary number of core balls arranged inside.

27. A pulverizer as set forth in claim 18, wherein each of said members forming the pulverizing medium is formed as one of a rod, a ball and a rectangular parallelepiped.

28. A pulverizer as set forth in claim 27, wherein each of said members forming the pulverizing medium is a hollow body and has through holes which are formed on its outer surface at necessary portions and communicate inside.

29. A pulverizer as set forth in claim 28, wherein each of said members forming the pulverizing medium is formed as a rod and has a necessary number of core bars arranged inside.

30. A pulverizer as set forth in claim 28, wherein each of said members forming the pulverizing medium is formed as one of a ball and a rectangular parallelepiped and has a necessary number of core balls arranged inside.

31. A pulverizer as set forth in claim 18, wherein each of said members forming the pulverizing medium is a hollow body and has through holes which are formed on its outer surface at necessary portions and communicate inside.

32. A pulverizer as set forth in claim 31, wherein each of said members forming the pulverizing medium is formed as a rod and has a necessary number of core bars arranged inside.

33. A pulverizer as set forth in claim 31, wherein each of said members forming the pulverizing medium is formed as one of a ball and a rectangular parallelepiped and has a necessary number of core balls arranged inside.

34. A pulverizer as set forth in claim 1, wherein said hollow rotator is formed as one of a circular cylinder, an elliptic cylinder, a sphere and a prism.

35. A pulverizer as set forth in claim 34, wherein each of said members forming the pulverizing medium is formed as one of a rod, a ball and a rectangular parallelepiped.

36. A pulverizer as set forth in claim 35, wherein each of said members forming the pulverizing medium is a hollow body and has through holes which are formed on its outer surface at necessary portions and communicate inside.

37. A pulverizer as set forth in claim 36, wherein each of said members forming the pulverizing medium is formed as a rod and has a necessary number of core bars arranged inside.

38. A pulverizer as set forth in claim 36, wherein each of said members forming the pulverizing medium is formed as one of a ball and a rectangular parallelepiped and has a necessary number of core balls arranged inside.

39. A pulverizer as set forth in claim 34, wherein each of said members forming the pulverizing medium is a hollow body and has through holes which are formed on its outer surface at necessary portions and communicate inside.

40. A pulverizer as set forth in claim 39, wherein each of said members forming the pulverizing medium is formed as a rod and has a necessary number of core bars arranged inside.

41. A pulverizer as set forth in claim 39, wherein each of said members forming the pulverizing medium is formed as one of a ball and a rectangular parallelepiped and has a necessary number of core balts arranged inside.

42. A pulverizer as set forth in claim 1, wherein each of said members forming the pulverizing medium is formed as one of a rod, a ball and a rectangular parallelepiped.

43. A pulverizer as set forth in claim 42, wherein each of said members forming the pulverizing medium is a hollow body and has through holes which are formed on its outer surface at necessary portions and communicate inside.

44. A pulverizer as set forth in claim 43, wherein each of said members forming the pulverizing medium is formed as a rod and has a necessary number of core bars arranged inside.

45. A pulverizer as set forth in claim 43, wherein each of said members forming the pulverizing medium is formed as one of a ball and a rectangular parallelepiped and has a necessary number of core balls arranged inside.

46. A pulverizer as set forth in claim 1, wherein each of said members forming the pulverizing medium is a hollow body and has through holes which are formed on its outer surface at necessary portions and communicate inside.

47. A pulverizer as set forth in claim 46, wherein each of said members forming the pulverizing medium is formed as a rod and has a necessary number of core bars arranged inside.

48. A pulverizer as set forth in claim 46, wherein each of said members forming the pulverizing medium is formed as one of a ball and a rectangular parallelepiped and has a necessary number of core balls arranged inside.

* * * * *